US012258844B2

(12) United States Patent
Sullivan

(10) Patent No.: US 12,258,844 B2
(45) Date of Patent: Mar. 25, 2025

(54) IGNITER FOR A SETTING TOOL FOR A PERFORATING GUN ASSEMBLY

(71) Applicant: XConnect, LLC, Denver, CO (US)

(72) Inventor: Shelby L. Sullivan, Minot, ND (US)

(73) Assignee: XConnect, LLC, Denver, CO (US)

( * ) Notice: Subject to any disclaimer, the term of this patent is extended or adjusted under 35 U.S.C. 154(b) by 129 days.

(21) Appl. No.: 18/353,602

(22) Filed: Jul. 17, 2023

(65) Prior Publication Data

US 2023/0366298 A1 Nov. 16, 2023

Related U.S. Application Data

(63) Continuation-in-part of application No. 17/547,053, filed on Dec. 9, 2021, now Pat. No. 11,940,261, which is a continuation-in-part of application No. 17/175,651, filed on Feb. 13, 2021, now Pat. No. 11,293,737, which is a continuation-in-part of application No. 16/996,692, filed on Aug. 18, 2020, now Pat. No. 11,402,190, which is a continuation-in-part of application No. 16/894,512, filed on Jun. 5, 2020, now Pat. No. 11,255,650.

(60) Provisional application No. 63/386,136, filed on Dec. 5, 2022, provisional application No. 63/373,727, filed on Aug. 28, 2022.

(51) Int. Cl.
*E21B 43/1185* (2006.01)
*E21B 33/12* (2006.01)

(52) U.S. Cl.
CPC ..... *E21B 43/11855* (2013.01); *E21B 33/12* (2013.01)

(58) Field of Classification Search
CPC ..... E21B 43/1185; E21B 43/11855; E21B 43/11857; E21B 43/11852
See application file for complete search history.

(56) References Cited

U.S. PATENT DOCUMENTS

| | | | |
|---|---|---|---|
| 3,186,485 | A | 6/1965 | Owen |
| 5,223,665 | A | 6/1993 | Burleson et al. |
| 5,396,951 | A | 3/1995 | Ross |
| 5,571,986 | A | 11/1996 | Snider et al. |

(Continued)

OTHER PUBLICATIONS

CPST Igniter Brochure; manufactured by Schlumberger; 2 pages.

(Continued)

*Primary Examiner* — Reginald S Tillman, Jr.
(74) *Attorney, Agent, or Firm* — Peter L. Brewer; Thrive IP

(57) ABSTRACT

An initiator system for actuating a wellbore setting tool for a plug or a packer. The initiator system includes a firing head that comprises a tubular body defining a bore, wherein the bore has an upstream chamber and a downstream chamber. A tubular bulkhead that resides within the bore of the firing head. The initiator system further includes a signal pin that has an elongated shaft residing within the tubular bulkhead. The initiator system also includes an ignition tube forming an ignition chamber between upstream and downstream ends. The upstream end of the ignition tube receives a second end of the tubular bulkhead. The initiator system further includes an ignitor that is in electrical communication with the signal pin. The initiator system also has an explosive component which resides within the ignition chamber at the downstream end, and is configured to initiate when the signal pin transmits an actuation signal to the igniter.

20 Claims, 12 Drawing Sheets

(56) References Cited

U.S. PATENT DOCUMENTS

| | | | |
|---|---|---|---|
| 5,911,277 | A | 6/1999 | Hromas et al. |
| 6,164,375 | A | 12/2000 | Carisella et al. |
| 6,257,331 | B1 | 7/2001 | Blount et al. |
| 7,322,416 | B2 | 1/2008 | Burris, II et al. |
| 9,476,289 | B2 | 10/2016 | Wells |
| 9,518,454 | B2 | 12/2016 | Current et al. |
| 9,598,942 | B2 | 3/2017 | Wells |
| 9,822,618 | B2 | 11/2017 | Eitschberger |
| 10,036,236 | B1 | 7/2018 | Sullivan et al. |
| 10,077,641 | B2 | 9/2018 | Rogman et al. |
| 10,472,939 | B2 | 11/2019 | Sullivan et al. |
| 10,920,544 | B2 | 2/2021 | Sullivan et al. |
| 11,156,067 | B2 | 10/2021 | Henke et al. |
| 11,208,873 | B2 | 12/2021 | Sullivan |
| 11,248,452 | B2 | 2/2022 | Sullivan et al. |
| 11,255,650 | B2 | 2/2022 | Sullivan et al. |
| 11,293,737 | B2 | 4/2022 | Sullivan et al. |
| 11,377,936 | B2 | 7/2022 | Sampson |
| 11,402,190 | B2 | 8/2022 | Sullivan et al. |
| 11,591,885 | B2 | 2/2023 | Eitschberger et al. |
| 2022/0412195 | A1 | 12/2022 | Vriend et al. |
| 2023/0193711 | A1 | 6/2023 | Eitschberger et al. |

OTHER PUBLICATIONS

CPST Pressure Setting Tool Brochure; https://www.slb.com/-/media/files/co/product-sheet/cpst-pressure-setting-tool. ashx; Copyright 2014; Schlumberger; 1 page.

Igniter for Setting Tool Brochure; DynaEnergetics; https://prod.sc.cm.dynaenergetics.com/-/media/Project/DMC/DynaEnergetics/Technical-Data-Sheets-PDF/C730_det_ist.pdf; Revised Apr. 7, 2017; 1 page.

IGNITER FOR A SETTING TOOL FOR A PERFORATING GUN ASSEMBLY

STATEMENT OF RELATED APPLICATIONS

The present application claims the benefit of U.S. Ser. No. 63/373,727 filed Aug. 28, 2022. That application was titled "Igniter for Setting Tool for a Perforating Gun Assembly."

The present application also claims the benefit of U.S. Ser. No. 63/386,136 filed Dec. 5, 2022. That application was also titled "Igniter for Setting Tool for a Perforating Gun Assembly."

This application is also filed as a Continuation-in-Part of U.S. Ser. No. 17/547,053 filed Dec. 9, 2021. That application was titled "Bulkhead for Perforating Gun Assembly."

The '053 patent application was filed as a Continuation-in-Part of U.S. Ser. No. 17/175,651 (1312.0007-US3). That application was filed on Feb. 13, 2021, and is entitled "Detonation System Having Sealed Explosive Initiation Assembly." The '651 application issued as U.S. Pat. No. 11,293,737 on Apr. 5, 2022.

The '651 patent application was filed as a Continuation-in-Part of U.S. Ser. No. 16/996,692 (1312.0007-US2). That application was filed on Aug. 18, 2020, and is also entitled "Detonation System Having Sealed Explosive Initiation Assembly." The '692 application issued on Aug. 2, 2022 as U.S. Pat. No. 11,402,190.

Each of these applications is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

TECHNICAL FIELD OF THE INVENTION

The present disclosure relates to the field of hydrocarbon recovery operations. More specifically, the invention relates to a perforating gun assembly used for the perforation of steel casing in a wellbore. Further still, the invention relates to an igniter system used to activate a setting tool located at a downstream end of the perforating gun assembly.

DISCUSSION OF THE BACKGROUND

For purposes of this disclosure, U.S. Pat. No. 11,402,190 will be referred to as "the parent application." The parent application has been incorporated herein in its entirety by reference.

In the drilling of an oil and gas well, a near-vertical wellbore is formed through the earth using a drill bit urged downwardly at a lower end of a drill string. After drilling to a predetermined depth, the drill string and drill bit are removed and the wellbore is lined with a string of steel casing. An annular area is thus formed between the string of casing and the formation penetrated by the wellbore.

A cementing operation is conducted in order to fill or "squeeze" the annular volume with cement along part or all of the length of the wellbore. The combination of cement and casing strengthens the wellbore and facilitates the zonal isolation, and subsequent completion, of hydrocarbon-producing pay zones behind the casing.

In connection with the completion of the wellbore, several strings of casing having progressively smaller outer diameters will be cemented into the wellbore. These will include a string of surface casing, one or more strings of intermediate casing, and lastly a string of production casing. The process of drilling and then cementing progressively smaller strings of casing is repeated until the well has reached total depth. In some instances, the final string of casing is a liner, that is, a string of casing that is not tied back to the surface.

Within the last two decades, advances in drilling technology have enabled oil and gas operators to "kick-off" and steer wellbore trajectories from a vertical orientation to a near-horizontal orientation. The horizontal "leg" of each of these wellbores now often exceeds a length of one mile, and sometimes two or even three miles. This significantly multiplies the wellbore exposure to a target hydrocarbon-bearing formation. The horizontal leg will typically include the production casing.

FIG. 1 is a side, cross-sectional view of a wellbore 100, in one embodiment. The wellbore 100 defines a bore 10 that has been drilled from an earth surface 105 (or simply, surface) into a subsurface 110. The wellbore 100 is formed using any known drilling mechanism, but preferably using a land-based rig or an offshore drilling rig operating on a platform.

The wellbore 100 is completed with a first string of casing 120, sometimes referred to as surface casing. The wellbore 100 is further completed with a second string of casing 130, typically referred to as an intermediate casing. In deeper wells, that is, wells completed below 7,500 feet, at least two intermediate strings of casing will be used. In FIG. 1, a second intermediate string of casing is shown at 140.

The wellbore 100 is finally completed with a string of production casing 150. In the view of FIG. 1, the production casing 150 extends from the surface 105 down to a subsurface formation, or "pay zone" 115. The wellbore 100 is completed horizontally, meaning that a near-horizontal "leg" 156 is provided within the pay zone 115. The production casing 150 extends substantially across the horizontal leg 156.

It is observed that the annular region around the surface casing 120 is filled with cement 125. The cement (or cement matrix) 125 serves to isolate the wellbore 100 from fresh water zones and potentially porous formations around the string of casing 120.

The annular regions around the intermediate casing strings 130, 140 are also filled with cement 135, 145. Similarly, the annular region around the production casing 150 is filled with cement 155. However, the cement 135, 145, 155 is optionally only placed behind the respective casing strings 130, 140, 150 up to the lowest joint of the immediately surrounding casing string. Thus, a non-cemented annular area 132 is typically preserved above the cement matrix 135, a non-cemented annular area 142 may optionally be preserved above the cement matrix 135, and a non-cemented annular area 152 is frequently preserved above the cement matrix 155.

The horizontal leg 156 of the wellbore 100 includes a heel 153, located at an inflection point between the near-vertical leg and near-horizontal leg of the wellbore 100, and a toe 154. In this instance, the toe 154 defines the end (or "TD") of the wellbore 100. In order to enhance the recovery of hydrocarbons, particularly in low-permeability formations, the casing 150 along the horizontal section 156 undergoes a process of perforating and fracturing (or in some cases perforating and acidizing). Due to the exceptionally long lengths of new horizontal wells, the perforating and formation treatment process is typically carried out in stages.

In one method, a perforating gun assembly 200 is pumped down the horizontal leg 156 at the end of a wireline 240. The perforating gun assembly 200 will include a series of perforating guns (shown at 210 in FIG. 2), with each gun having sets of charges ready for detonation. The charges associated with one of the perforating guns 210 are detonated and perforations (not shown) are "shot" into the casing 150. Those of ordinary skill in the art will understand that a perforating gun 210 has explosive charges, typically shaped, hollow or projectile charges, which are ignited to create holes in the casing 150 (and, if present, the surrounding cement) and pass at least a few inches and possibly several feet into the subsurface formation 115. The perforations create fluid communication with the surrounding formation 115 (or pay zone) so that hydrocarbon fluids can flow into the casing 150.

After perforating, the operator will fracture (or otherwise stimulate) the formation 115 through the perforations (not shown). This is done by pumping treatment fluids into the formation 115 at a pressure above a formation parting pressure. After the fracturing operation is complete, the wireline 240 will be raised from the surface and the perforating gun assembly 200 will be positioned at a new location (or "depth") along the horizontal wellbore 156. A plug (such as plug 112) is set below the perforating gun assembly 200 using a setting tool 160, and new shots are fired in order to create a new set of perforations. Thereafter, treatment fluid is again pumping into the wellbore 100 and into the formation 115. In this way, a second set (or "cluster") of fractures is formed away from the horizontal leg 156 of the wellbore 100.

The process of setting a plug, perforating the casing, and fracturing the formation is repeated in multiple stages until the wellbore 100 has been completed, that is, the wellbore 100 is ready for production. In FIG. 1, it can be seen that two separate plugs 112 have been placed along the horizontal leg 156 of the wellbore 100. Of course, it is understood that the horizontal leg 156 of the completed wellbore 100 may extend many hundreds or even thousands of feet, with multiple plugs 112 being set between the stages. A string of production tubing (not shown) is then placed in the wellbore 100 to provide a conduit for production fluids to flow up to the surface 105.

In order to provide perforations for the multiple stages without having to pull the perforating gun assembly 200 after every detonation, the perforating gun assembly 200 employs multiple guns 210 in series. FIG. 2 is a side view of an illustrative perforating gun assembly 200, or at least a portion of an assembly. The perforating gun assembly 200 comprises a string of individual perforating guns 210.

Each perforating gun 210 represents various components. These typically include a "gun barrel" 212 which serves as an outer tubular housing. An uppermost gun barrel (or gun barrel housing 212) is supported by an electric wire (or "e-line") 240 that extends from the surface 105 and delivers electrical energy down to the perforating gun assembly 200. Each perforating gun 210 also includes an explosive initiator, or "detonator" (shown in phantom at 229). The detonator 229 is typically a small aluminum housing having an internal resistor. The detonator 229 receives electrical energy from the surface 105 and through the e-line 240, which heats the resistor.

The detonator 229 is surrounded by a sensitive explosive material such as RDX (or hexogen). When an electrical current is run through the detonator 229, a small explosion is set off by the electrically heated resistor. Stated another way, the explosive material is ignited by the detonator 229. This small explosion sets off an adjacent detonating cord (not shown). When ignited, the detonating cord initiates one or more shots, typically referred to as "shaped charges." The shaped charges (shown at 520 in FIG. 5 of the parent application) are held in an inner tube (shown at 500 in FIG. 5 of the parent application), referred to as a carrier tube, for security and discharge through openings 215 in the selected gun barrel 212. As the RDX is ignited, the detonating cord propagates an explosion down its length to each of the shaped charges along the carrier tube.

The perforating gun assembly 200 may include short centralizer subs 220. The perforating gun assembly 200 also includes the inner tubes, which reside within the gun barrel housings 212 and are not visible in FIG. 2. In addition, tandem subs 225 are used to connect the gun barrel housings 212 end-to-end. Each tandem sub 225 comprises a metal threaded connector placed between the perforating guns 210. (A complete tandem sub is shown at 400 in FIG. 4 of the parent application.) Typically, the gun barrel housings 212 will have female-by-female threaded ends while the tandem subs 225 have opposing male threaded ends (indicated at 404 of the parent application).

The perforating gun assembly 200 with its long string of gun barrels (the housings 212 of the perforating guns 210 and the carrier tubes) is carefully assembled at the surface 105, and then lowered into the wellbore 10 at the end of the e-line 240. The e-line 240 extends upward to a control interface (not shown) located at the surface 105. An insulated connection member 230 connects the e-line 240 to the uppermost perforating gun 210. Once the perforating gun assembly 200 is in place within the wellbore 100, the operator of the control interface sends electrical signals to the perforating gun assembly 200 for detonating the shaped charges (shown at 520 of the parent application) and for creating perforations into the casing 150.

As noted in FIGS. 1 and 2, a setting tool 160 resides at the end of the perforating gun assembly 200. The setting tool 160 may be connected to the lowermost perforating gun 210 by means of a tandem sub 225 and an adapter 162. The setting tool 160 is used to set the plug 112 along the wellbore 100 at a desired depth. This is typically done by using an igniter which initiates the burning of an explosive component.

After the casing 150 has been perforated and at least one plug 112 has been set, the setting tool 160 and the perforating gun assembly 200 are removed from the wellbore 100 and a ball (not shown) is dropped into the wellbore 100 to close the plug 112. When the plug 112 is closed, a fluid (e.g., water, water and sand, fracturing fluid, etc.) is pumped by a pumping system down the wellbore 100 (typically through coiled tubing) for fracturing purposes. For a formation fracturing operation, the pumping system will create downhole pressure that is above the formation parting pressure.

As noted, the above operations may be repeated multiple times for perforating and/or fracturing the casing 150 at multiple locations, corresponding to different stages of the wellbore 100. Multiple plugs 112 may be used for isolating the respective stages from each other during the fracturing phases. When the fracturing of the casing 150 is completed for all stages, the plugs 112 are drilled out and the wellbore 100 is cleaned using a circulating tool.

It can be appreciated that a reliable actuation signal must be provided to the igniter to initiate the burning of the power charge housed within the setting tool 160. This causes a chemical reaction that strokes the setting tool 160 and sets the plug 112. However, a need exists for a bulkhead that resides within the tandem sub 225 below the lowermost gun barrel housing 212 that reliably transmits an actuation signal to an igniter. This actuation signal is sent before charges in the lowermost gun barrel housing are detonated.

SUMMARY OF THE INVENTION

An initiator system for a setting tool is provided. The initiator system is designed for use with a perforating gun assembly for perforating a wellbore. Specifically, the initiator system is used to actuate a setting tool for a plug or a packer in a wellbore. In one aspect, the plug is a so-called frac plug that resides at the end of, or below, the perforating gun assembly.

The initiator system first includes a firing head. The firing head comprises a tubular body having a first end, and a second end opposite the first end. The tubular body defines a bore extending from the first end to the second end, with the bore having an upstream chamber and a downstream chamber. Preferably, the firing head is fabricated from steel.

The initiator system also comprises a bulkhead. The bulkhead resides within the bore of the firing head. The bulkhead has a first end, a second end, and a receptacle extending between the first and second ends. The bulkhead comprises a tubular body fabricated from a non-conductive material such as plastic (a polycarbonate) or nylon.

The initiator system further includes a signal pin. The signal pin has an elongated shaft residing within the receptacle of the tubular bulkhead. The signal pin extends from the second end of the tubular bulkhead, and is fabricated from an electrically conductive material for transmitting actuation signals. Preferably, the signal pin is fabricated from brass.

The initiator system also comprises an ignition tube. The ignition tube comprises a cylindrical body having an upstream end and a downstream end. The ignition tube forms an ignition chamber between the upstream and downstream ends of the ignition tube. Of interest, the upstream end of the ignition tube receives the second end of the tubular bulkhead within the downstream end of the bore of the firing head.

As the name implies, the initiator system further includes an ignitor. The ignitor resides within the ignition chamber, with the ignitor being in electrical communication with the second end of the signal pin. The ignitor may be in electrical communication with the second end of the signal pin by means of an electric wire.

The initiator system may also comprise:

an addressable switch; and a switch housing holding the addressable switch, with the switch housing residing within the upstream chamber of the bore of the firing head.

The initiator system also has an explosive component. In this respect, the igniter houses a small explosive load. The explosive component resides within the ignition chamber. The explosive component is configured to initiate when the signal pin transmits the electrical actuation signal to the igniter. The explosive component may then, in turn, initiate a power charge positioned within the setting tool.

In a preferred arrangement, the first end of the tubular body of the firing head is threadedly connected to a gun barrel housing of a perforating gun. The gun barrel housing comprises an electric line (or "e-line") that transmits signals. The addressable switch is in electrical communication with the electric line and is configured to receive (i) detonation signals for perforating gun charges in the gun barrel housing. It is understood that this signal would only be sent after a separate signal was sent to the igniter, causing the setting tool to set the fracturing plug. Thus, the electric line is also configured to (ii) transmit the actuation signal to the signal pin and on to the igniter.

Also in a preferred arrangement, the elongated shaft of the signal pin also extends from the first end of the tubular bulkhead. A banana clip may be placed over the first end of the signal pin. The banana clip extends at least partially into the switch housing and places the addressable switch in electrical communication with the signal pin.

A method of actuating a setting tool in a wellbore is also provided herein. In one aspect, the method first comprises providing a firing head. The firing head may be in accordance with the firing head described above in its various arrangements. In one embodiment, the firing head comprises:

a tubular body having a first end, and a second end opposite the first end;

a bore extending from the first end to the second end, wherein the bore of the firing head has an upstream chamber and a downstream chamber;

a tubular bulkhead residing in the bore of the firing head, with the tubular bulkhead having a first end, a second end, and a receptacle extending between the first end and the second end;

a signal pin having an elongated shaft residing within the receptacle of the tubular bulkhead and extending out from the second end of the tubular bulkhead, wherein the signal pin is fabricated from an electrically conductive material for transmitting an actuation signal;

a cylindrical ignition tube having an upstream end and a downstream end forming an ignition chamber there between, wherein the upstream end of the ignition tube receives the second end of the tubular bulkhead within the downstream chamber of the bore of the firing head;

an ignitor residing within the ignition chamber, with the ignitor being in electrical communication with the second end of the signal pin; and an explosive component also residing within the ignition chamber.

The method also includes placing an addressable switch in the upstream chamber.

The method further comprises mechanically attaching the firing head to a lowermost perforating gun along a perforating gun assembly, wherein the perforating gun assembly receives an electric line.

Additionally, the method includes electrically connecting an upstream end of the signal pin to the electric line, and electrically connecting a downstream end of the signal pin to the igniter.

The method also comprises mechanically attaching a setting tool for setting a fracturing plug to a lowermost end of the firing head. The method then includes sending an actuation signal from a surface of the wellbore, through the electric line, to the signal pin in the bulkhead, and to the ignitor, and thereby initiating the explosive component. This, in turn, ignites a power charge in the setting tool, causing the fracturing plug to be set in the wellbore.

In one aspect, an upstream end of the signal pin extends out from the first (or upstream) end of the bulkhead, while a downstream end of the signal pin extends out from the second (or downstream) end of the bulkhead. In this instance, a banana clip may be placed over the first end of the signal pin. The electric line is in electrical communication with the banana clip, and the banana clip extends at least partially into the switch housing and places the addressable switch in electrical communication with the signal pin. Thus, a solderless connection is provided.

In another aspect, an upstream end of the signal pin resides entirely within the receptacle of the tubular bulkhead. Here. the signal pin receives the actuation signal from a pre-wired bullet terminal inserted into the first end of the tubular bulkhead. This again produces a solderless connection. Alternatively, the actuation signal is received from a conductive post threaded into an upstream end of the tubular bulkhead. The electric line is in electrical communication with the pre-wired bullet terminal (or the threaded conductive post).

In either aspect, a ground wire may be connected to the igniter. The cylindrical ignition tube is crimped onto the second end of the tubular bulkhead, and the ground wire is wrapped around the second end of the tubular bulkhead beneath the cylindrical ignition tube. This provides a solderless crimp connection for the ground wire.

In one arrangement, the explosive component ignites in response to resistive heat generated when the signal pin transmits the actuation signal to the igniter.

In one aspect, the method may also include removing the perforating gun assembly and the firing head from the wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the disclosures herein may admit to other equally effective embodiments and applications.

DEFINITIONS

Figure 1:
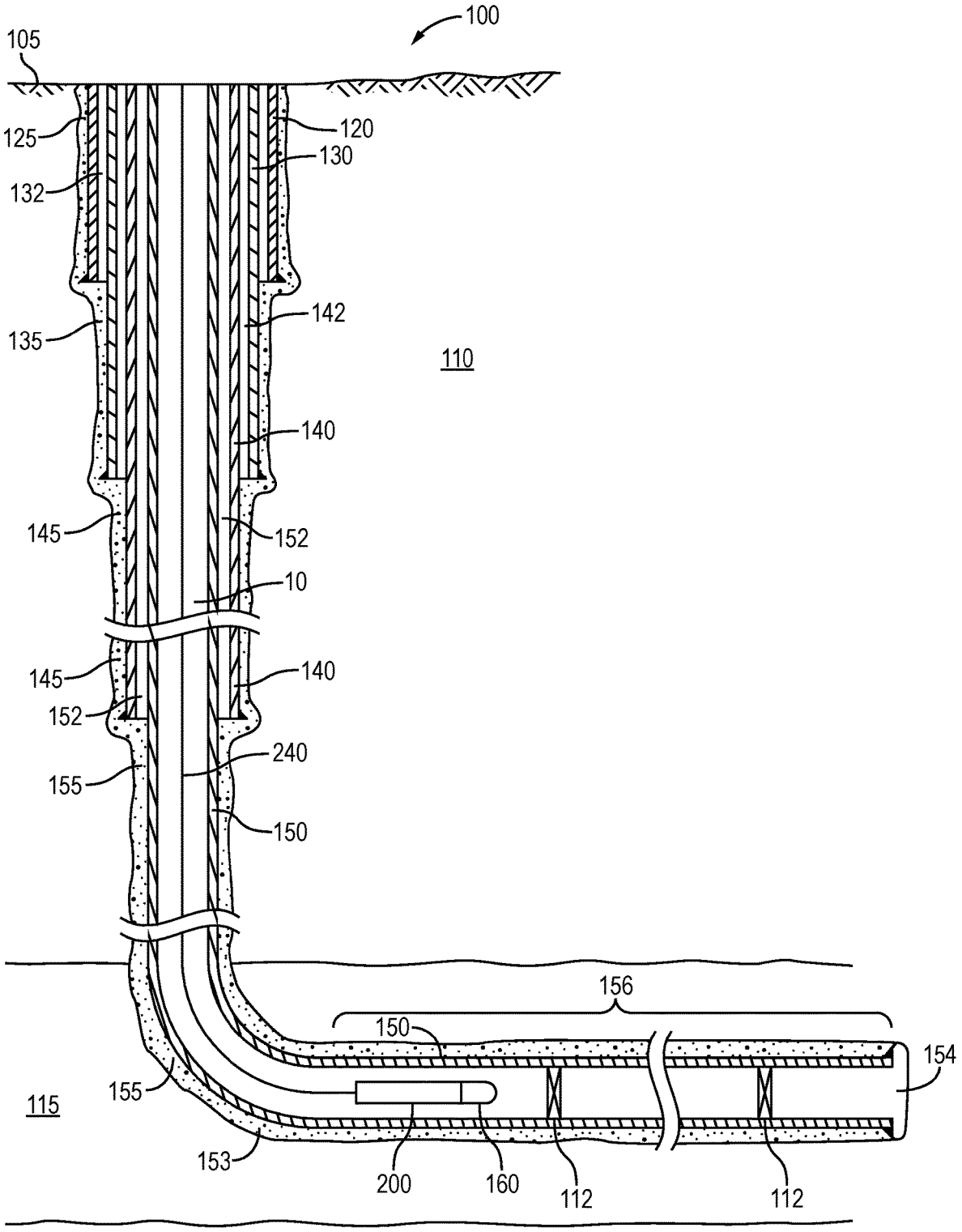
FIG. 1 (Prior Art)
FIG. 1 is a cross-sectional side view of a wellbore. The wellbore is being completed with a horizontal leg. A perforating gun assembly is shown having been pumped into the horizontal leg at the end of an e-line.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, carbon dioxide, and/or sulfuric components such as hydrogen sulfide.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, nitrogen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "surface" refers to a location on the earth's surface. The surface may be a land surface or a water surface.

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, (i) the creation, generation and/or entrapment of hydrocarbons or minerals, and (ii) the execution of processes used to extract hydrocarbons or minerals from the subsurface region.

As used herein, the term "wellbore" refers to a hole in the subsurface made by drilling or insertion of a conduit into the subsurface. A wellbore may have a substantially circular cross section, or other cross-sectional shapes. The term "well," when referring to an opening in the formation, may be used interchangeably with the term "wellbore."

Reference herein to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

DETAILED DESCRIPTION OF CERTAIN EMBODIMENTS

The following description of the embodiments refers to the accompanying drawings. The same reference numbers in different drawings identify the same or similar elements. The following detailed description does not limit the invention; instead, the scope of the inventions is defined by the appended claims.

In the following, the terms "upstream" and "downstream" are being used to indicate that one gun barrel of a perforating gun may be situated above and one below another gun barrel, respectively. However, one skilled in the art would understand that the present disclosure is not limited only to the upstream gun or only to the downstream gun, but in fact can be applied to either gun. In other words, the terms "upstream" and "downstream" are not necessarily used in a restrictive manner, but only to indicate, in a specific embodiment, the relative positions of perforating guns or other components.

Figure 2:
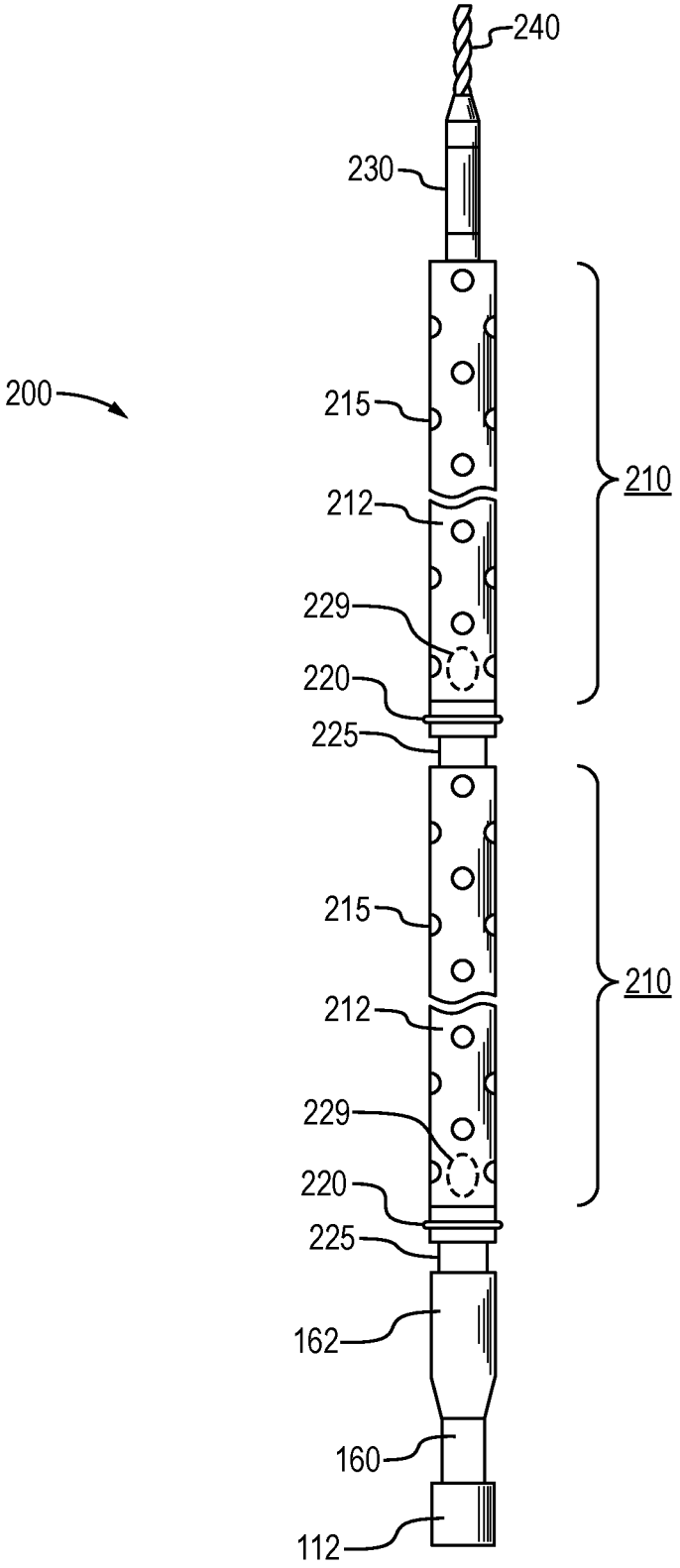
FIG. 2 (Prior Art)
FIG. 2 is a side view of a perforating gun assembly. The perforating gun assembly represents a series of perforating guns having been threadedly connected end-to-end. Tandem subs are shown between gun barrels of the perforating guns, providing the threaded connections. A plug is provided at a downstream end of the perforating gun assembly.
Figure 3A:
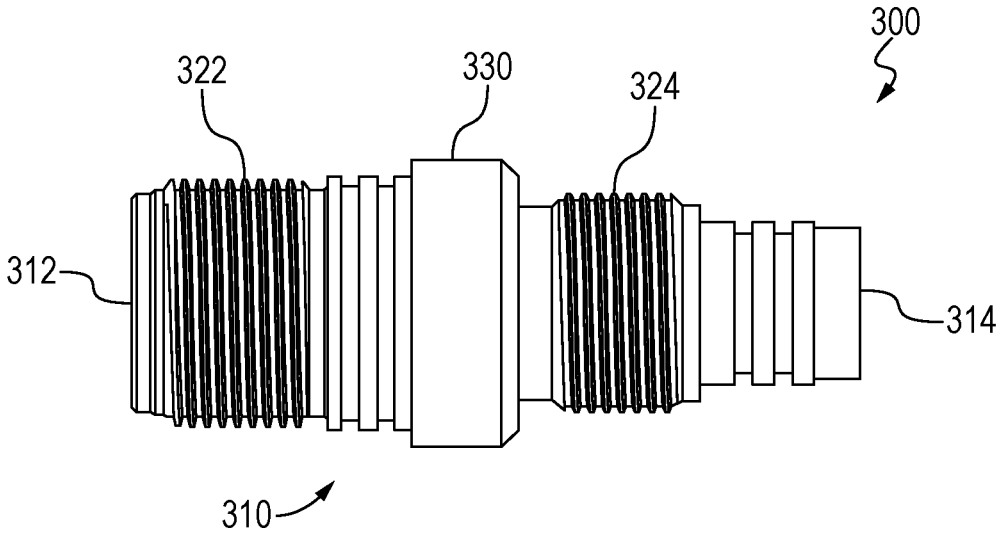
FIG. 3A is a side view of a novel tandem sub for connecting a perforating gun to a setting tool in a wellbore. The tandem sub may be referred to in this context as a firing head.
Figure 3B:
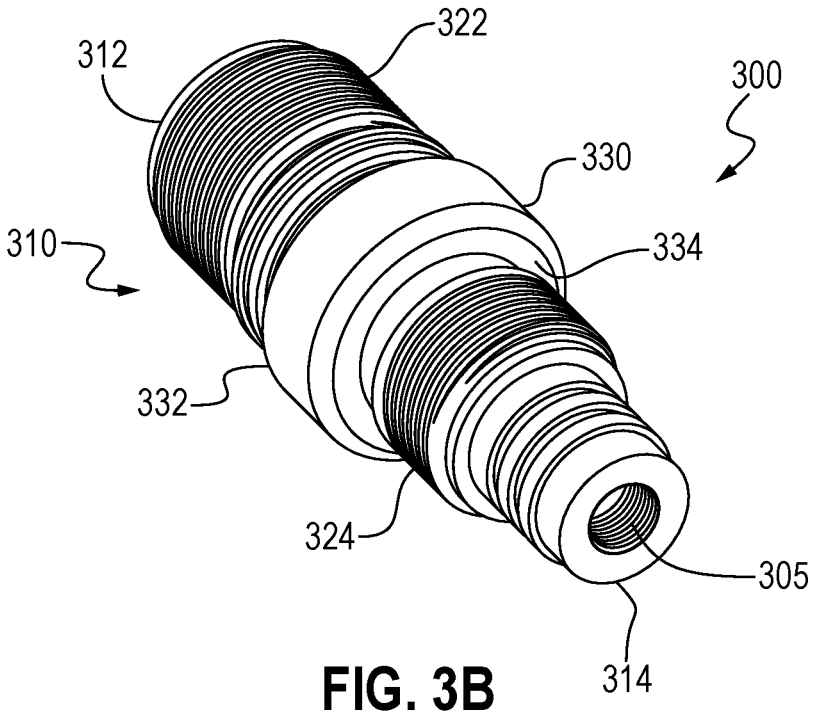
FIG. 3B is a perspective view of the firing head of FIG. 3A.

FIG. 3A is a side view of a tandem sub 300 for connecting a perforating gun (such as perforating gun 200 shown in FIG. 2) to a setting tool 160 (as shown in FIG. 2) in a wellbore 100. FIG. 3B is a perspective view of the tandem sub 300 of FIG. 3A. The tandem sub 300 will be referred to in this context as a firing head. The firing head 300 will be described in connection with FIGS. 3A and 3B together.

The firing head 300 comprises a body 310. The body 310 has a first end 312 and a second end 314 opposite the first end 312. The first end 312 resides in an upstream position within a wellbore (such as wellbore 100), while the second end 314 resides in a downstream position within the wellbore 100.

The body 310 has an inner bore 305 which extends from the first end 312 to the second end 314. The body 310 is dimensioned to contain components of an initiator assembly (shown at 600 in FIG. 6A and discussed below). The body 310 includes threads 322 proximate the upstream end 312 of the body 310. The threads 322 are used to connect to a downstream end of a perforating gun 210, particularly, to a gun barrel housing 212 (as shown in FIG. 2) of a lowermost perforating gun 210 in a perforating gun assembly 200. Preferably, threads 322 are male threads. At the same time, threads 324 connect to the upstream end of a setting tool adapter (shown at 162 in FIG. 2). Preferably, threads 324 are also male threads.

The body 310 of the firing head 300 includes a shoulder 330. The shoulder 330 comprises an upstream side 332 and a downstream side 334. The upstream side 332 serves as a stop member that prevents over-threading of the gun barrel housing 212, while the downstream side 334 serves as a stop member that prevents over-threading of the setting tool adapter 162.

Figure 3C:
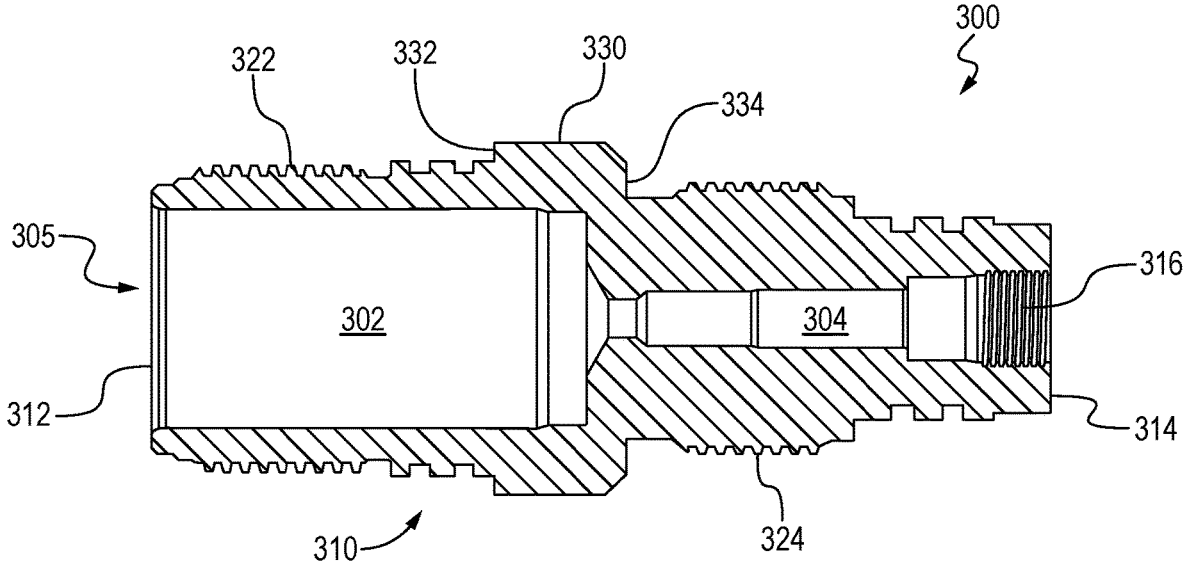
FIG. 3C is a cross-sectional view of the firing head of FIG. 3A.

FIG. 3C is a cross-sectional view of the firing head 300 of FIG. 3A. In this view, the bore 305 is more clearly seen. The bore 305 comprises an upstream chamber 302 and a downstream chamber 304. The upstream chamber 302 is dimensioned to house a switch housing (seen at 350 in FIGS. 4A and 4B). At the same time, the downstream chamber 304 is dimensioned to receive a bulkhead (seen at 510 in FIG. 4A). In a preferred embodiment, the upstream chamber 302 is dimensioned to be larger than the downstream chamber 304.

The downstream end 314 of the firing head 300 includes female threads 316. The female threads 316 receive a retainer (shown at 317 in FIG. 4A) of the igniter 630.

Figure 4A:
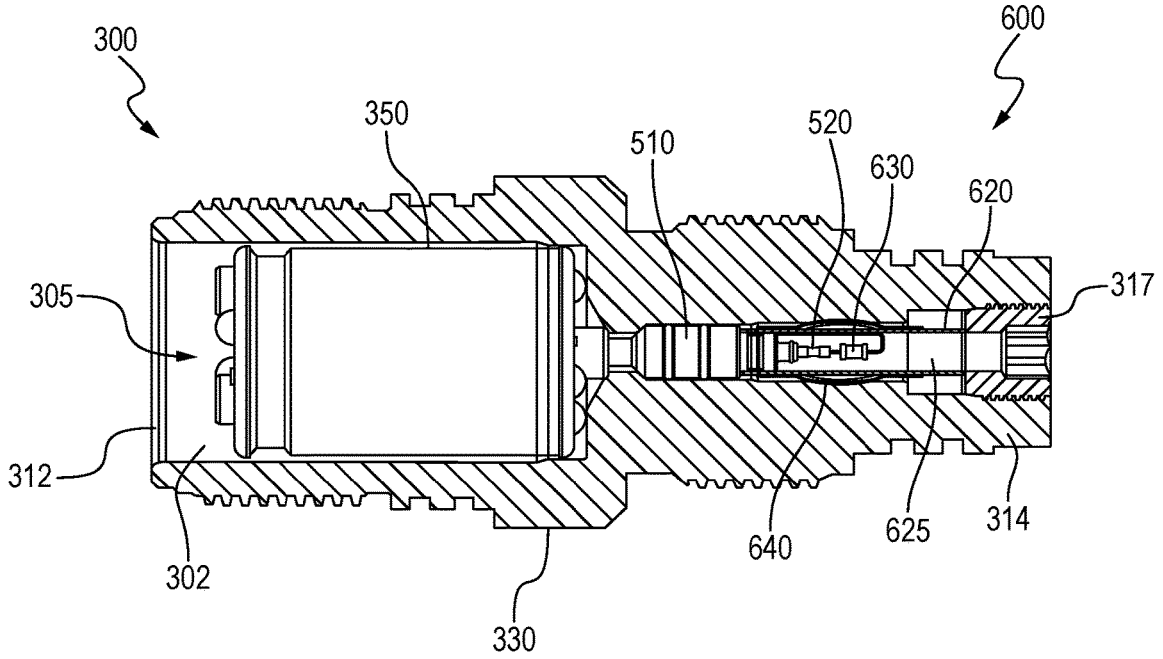
FIG. 4A is another cross-sectional view of the firing head of FIG. 3A. Here, a switch housing and an initiator assembly have been placed within a bore of the firing head.

FIG. 4A is another cross-sectional view of the firing head 300 of FIG. 3A. Here, the switch housing 350 is shown as placed within the upstream chamber 302 of the firing head 300.

Figure 4B:
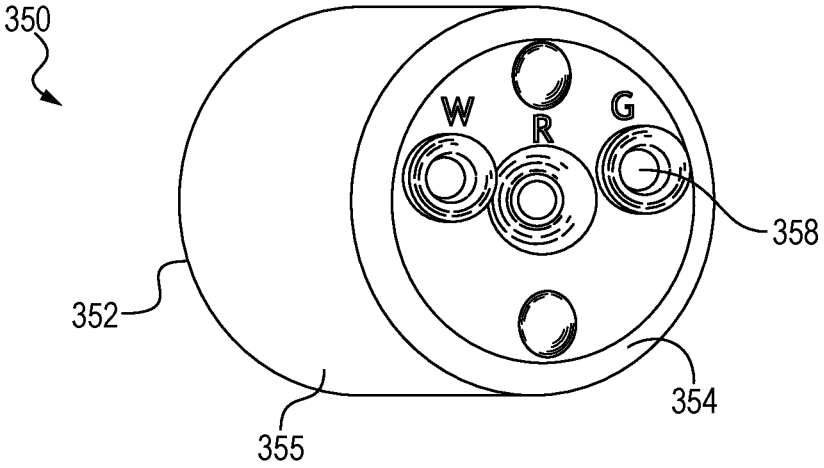
FIG. 4B is a perspective view of the switch housing that resides within the firing head of FIG. 4A.

FIG. 4B is a perspective view of the switch housing 350. The switch housing 350 is dimensioned to reside within the upstream chamber 302 of the firing head 300 of FIG. 4A. The switch housing 350 defines a cylindrical body 355 having a proximal end 352 and a distal end 354. Preferably, the switch housing 350 is fabricated from a shock-absorbing rubber compound.

Both the proximal end 352 and the distal end 354 of the switch housing 350 include contact ports 358. In the view of FIG. 4B, contact ports 358 are visible at the distal end 354. The contact ports 358 are labeled "W," "R," and "G," indicating White, Red, and Green, respectively. In electrical parlance, white (or sometimes black) indicates a negative wire or contact; red indicates a positive wire or contact; and green indicates a ground wire or contact. In the present arrangement, white indicates a signal line, red indicates the ground, and green indicates the detonation line. In one aspect, a signal pin is attachable to (or otherwise in electrical communication with) the white contact port, a detonator pin is attachable to (or otherwise in electrical communication with) the green contact port, and a ground pin (or post) is attachable to the red contact port.

Figure 4C:
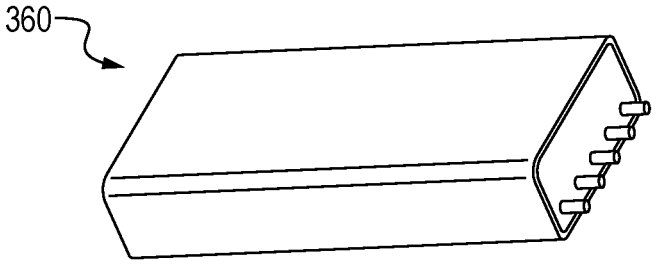
FIG. 4C is a perspective view of the addressable switch that resides within the switch housing of FIG. 4B.

FIG. 4C is a perspective view of an addressable switch 360 which resides within the switch housing 350 of FIG. 4B, in one embodiment. The addressable switch 360 contains electronics such as a circuit board or perhaps a 3-pin push-on connector. The addressable switch 360 is installed in the switch housing 350 and placed in electrical communication with the ground pin, the signal transmission pin, and the detonator pin. The ground pin (710), the signal transmission pin (720'), and the detonator pin (720") are all shown in the parent application.

As described more fully in the parent application, the addressable switch 360 receives signals from the surface as sent by an operator, which is transmitted through a signal transmission wire or pin, and filters those signals to identify an actuation signal. If an actuation signal is identified, then a signal is separately sent for detonation of charges in an adjacent upstream perforating gun 210. If an actuation signal is not detected, then the signal will travel on to the igniter 630.

Components of an initiator assembly 600 are also seen in FIG. 4A. The initiator assembly 600 first includes a bulkhead 510. The bulkhead 510 defines an elongated cylindrical body (shown at 515 in FIG. 5B) that is sealingly received within the downstream chamber 304 of the bore 305. Sealing may be accomplished through elastomeric O-rings (shown at 513 in FIG. 5A).

The bulkhead 510 is in electrical communication with a signal wire associated with the addressable switch 360. In a preferred arrangement, this is done by means of a banana clip (shown at 523 in FIG. 5A). As will be discussed more fully below, the bulkhead 510 transmits an initiation signal to an igniter 630 downstream.

Figure 5A:
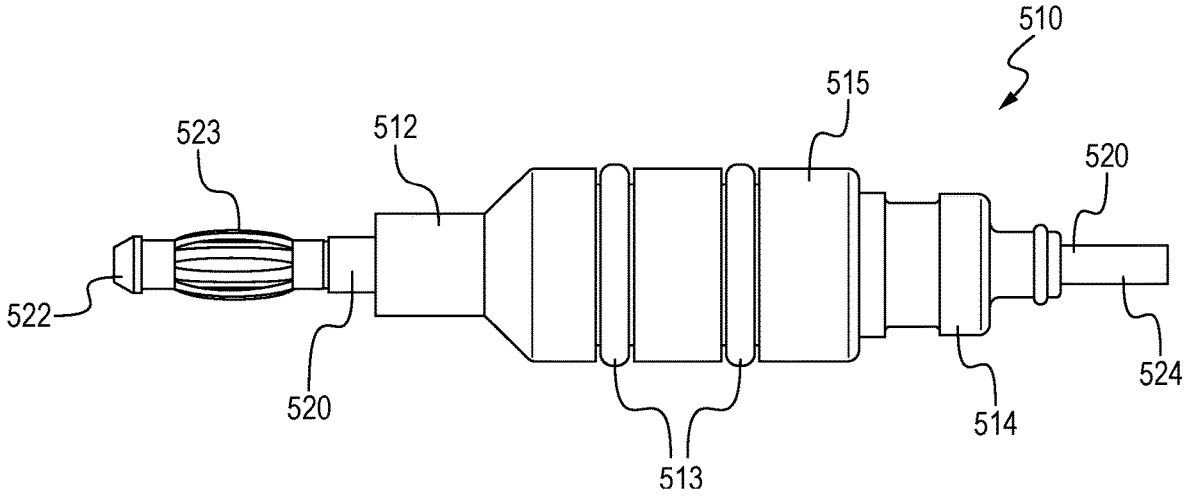
FIG. 5A is a side view of a bulkhead used in the initiator assembly of the present invention, in one embodiment. An upstream end of the bulkhead includes a banana clip used as an electrical connector.

FIG. 5A is a side view of the bulkhead 510 as used in the initiator assembly 600 of the present invention, in one embodiment. The bulkhead 510 comprises a bulkhead body 515. The bulkhead body 515 defines an elongated cylindrical shape. In this respect, the bulkhead body 515 includes an outer diameter and an inner diameter. The bulkhead body 515 is preferably fabricated from a non-conductive material such as plastic (a polycarbonate) or nylon or composite material.

The bulkhead body 515 has a first end 512 and a second end 514 opposite the first end 512. The first end 512 serves as an upstream end and is designed to slide into (or to at least engage) a downstream end of the switch housing 350. At the same time, the second end 514 serves as a downstream end and extends into an ignition tube 620 (seen in FIGS. 4A and 6A).

A bore (not shown) extends from the first end 512 to the second end 514 of the bulkhead body 515. The bore represents the inner diameter of the bulkhead body 515 and is configured to hold an elongated pin 520. In the view of FIG. 5A, an upstream end 522 of the elongated pin 520 is visible extending from the first end 512 of the bulkhead body 515. Likewise, a downstream end 524 of the elongated pin 520 is visible extending from the second end 514 of the bulkhead body 515. It is understood that the elongated pin 520 extends through the bore of the bulkhead body 515 along its length, such as is shown in U.S. Pat. No. 11,255,162, co-owned by Applicant herein.

The elongated pin 520 is fabricated from an electrically conductive material. Preferably, the electrically conductive material is brass.

Figure 5B:
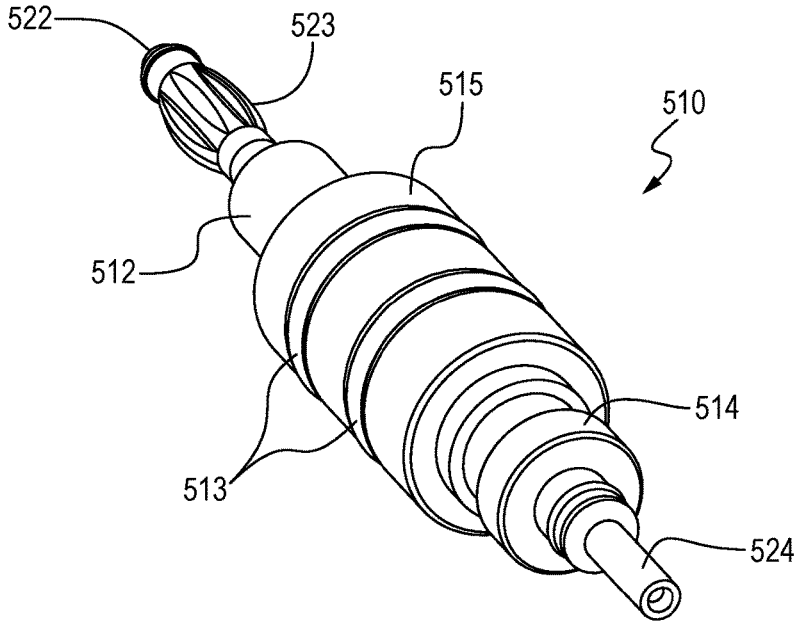
FIG. 5B is a first perspective view of the bulkhead of FIG. 5A. Here, the bulkhead is seen from a downstream end.

FIG. 5B is a first perspective view of the bulkhead 510 of FIG. 5A. The downstream end 524 of the signal pin 520 is visible. The signal pin 520 may be tubular, forming a receiving bore therein.

Figure 5C:
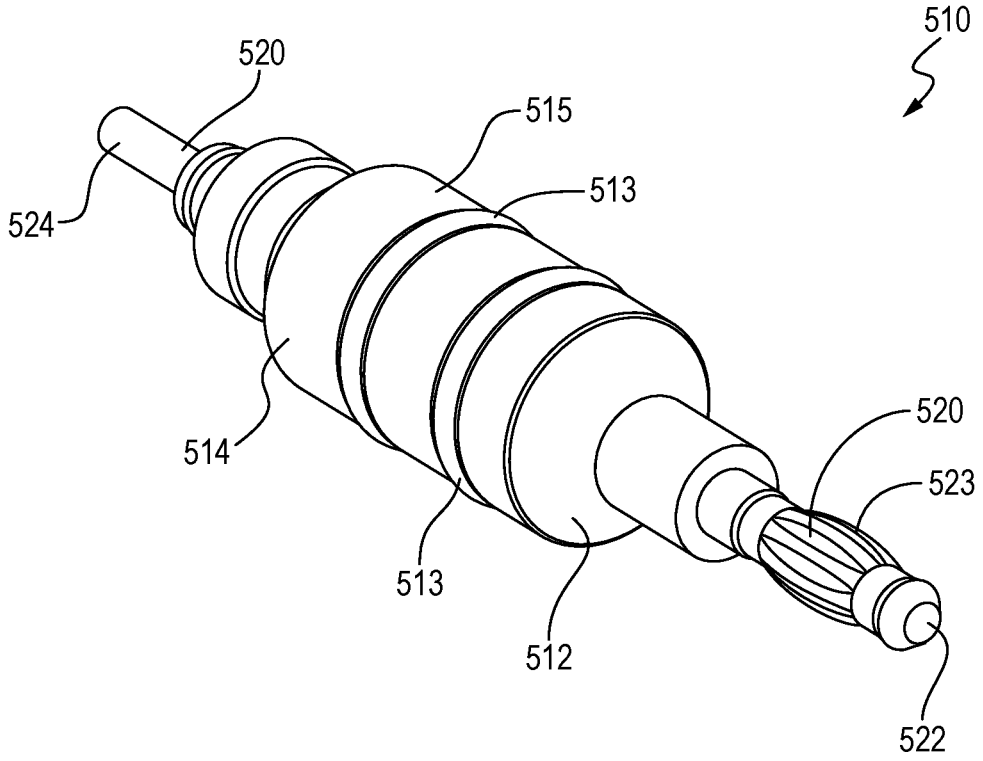
FIG. 5C is a second perspective view of the bulkhead of FIG. 5A. Here, the bulkhead is seen from an upstream end.

FIG. 5C is a second perspective view of the bulkhead 510 of FIG. 5A. The elongated pin (or brass contact pin) 520 is seen extending from the upstream end 512 of the bulkhead body 515. In addition, elastomeric O-rings 513 are shown around the outer diameter of the bulkhead body 515. The elastomeric O-rings 513 provide a fluidic seal between the switch housing 350 and the downstream chamber 304.

Figure 6A:
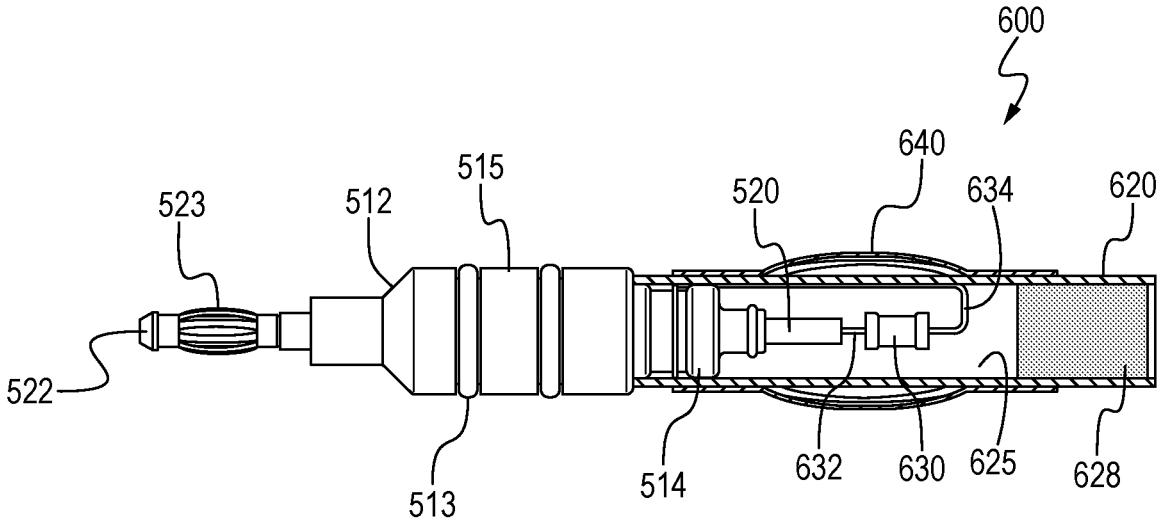
FIG. 6A is another side view of the bulkhead of FIG. 5A. Here, the bulkhead is in electrical communication with an igniter.

FIG. 6A is another side view of the bulkhead 510 of FIG. 5A. Here, the bulkhead 510 is in electrical communication with the igniter 630. The bulkhead 510, the igniter 630, and other components shown in FIG. 6A together make up an initiator assembly 600.

It can be seen that the second (or downstream) end 514 of the bulkhead 510 extends into a small tubular sub. This is referred to as an ignition tube 620. The ignition tube 620 provides a chamber 625 that receives the second end 524 of the brass pin 520. This chamber 625 serves as an ignition chamber.

The bulkhead 510 and the ignition tube 620 together reside within the downstream chamber 304 of the firing head 300. Optionally, a centralizer 640 is provided around the ignition tube 620 in order to properly locate the position of the igniter 630 within the downstream chamber 304 of the firing head 300.

The brass contact pin 520 is in electrical communication with the igniter 630 by means of a wire 632. The wire 632 transmits electrical current from the brass pin 520 to the igniter 630 in response to receiving a signal from the surface 105. The signal passes through the addressable switch 360, which permits an actuation signal to pass to the bulkhead 510 upon recognizing a digital instruction. Upon receiving the actuation signal, the igniter 630 generates resistive heat by way of the electrical current within the ignition chamber 625.

The ignition chamber 625 increases in heat in response to the electrical actuation signal. This, in turn, ignites an explosive component 628. The explosive component 628, in turn, burns and initiates a power charge residing in the setting tool 160. The power charge then burns, creating high pressure to activate the setting tool 160. In one aspect, the power charge builds pressure (sometimes in excess of 20,000 psi) and strokes the setting tool 160, releasing and setting the plug 112. Alternatively, the setting tool 160 may be used to release and set a packer.

Figure 6B:
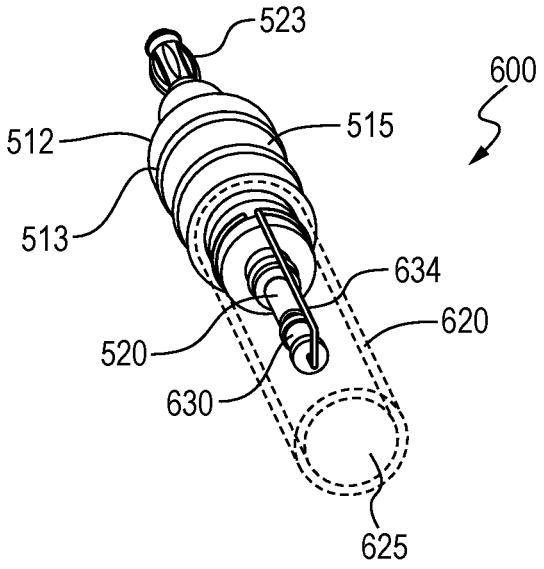
FIG. 6B is a perspective view of the bulkhead and igniter of FIG. 6A. The igniter resides within an ignition tube. The ignition tube is shown in phantom.

FIG. 6B is a perspective view of the bulkhead 510 and igniter 630 of FIG. 6A. The igniter 630 is seen residing within the ignition chamber 625 (shown in phantom). Of interest, a ground wire 634 is shown extending from a downstream end of the igniter 630. The ground wire 634 loops back into the bulkhead body 515 and is retained underneath and in contact with the metallic ignition chamber 620 the in order to complete the electrical circuit to ground. This connection is made without the need for solder or welding by crimping the ignition chamber tube 620 over the downstream end 714 of the bulkhead body 715.

Preferably, the brass contact pin 520 comprises a plurality of grooves (shown at 424 in FIG. 4B of U.S. Pat. No. 11,255,162) within the bore (such as bore 705 in FIG. 7B). In one embodiment, the plurality of grooves comprises at least three grooves, and preferably five or even six grooves equi-distantly spaced along the shaft (such as shaft 425 of the '162 patent) between the ends 522, 524 of the pin 520. At the same time, the bore 705 comprises a profile for mating with the plurality of grooves (such as grooves 426 of the '162 patent) of the pin 720. This grooved, interlocking arrangement increases shear strength of the bulkhead body 515.

Preferably, the shaft (shown at 425 of the '162 patent) comprises a conical portion (427 of the '162 patent) proximate the first end (423 of the '162 patent) that frictionally fits into a mating conical profile of the bore (415 of the '162 patent). This further enhances shear strength of the bulkhead body 515. U.S. Pat. No. 11,255,162 is incorporated herein in its entirety by reference.

It is noted that as used by the Applicant, bulkheads are small, electrically insulative tubular bodies that hold one or more signal pins. The connection between signal wires and the ends of the signal pins represents a point of potential weakness. Accordingly, Applicant has designed a banana clip 523 that engages or goes over the first end 522 of the brass pin 520. The banana clip 523 serves as a ready electrical connector for the addressable switch 360.

It is recognized that some manufacturers may desire to incorporate the initiator assembly 600 herein into their own detonator assemblies. In that case, the first end 522 and the banana clip 523 may be completely removed to permit compatibility with alternate detonator assemblies.

Figure 7A:
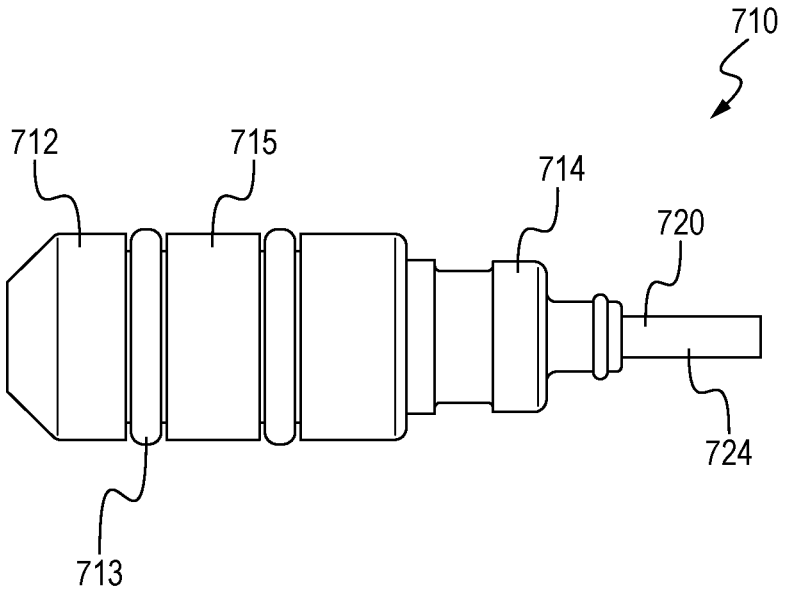
FIG. 7A is a side view of a bulkhead as may be used in the initiator assembly of the present invention, in a second embodiment. An upstream end of the bulkhead is left blank.

FIG. 7A is a side view of a bulkhead 710 as may be used in the initiator assembly 600 of the present invention, in a second embodiment. The bulkhead 710 is generally in accordance with the bulkhead 510 of FIG. 5A. However, the upstream end of the brass contact pin 522 has been removed.

As with bulkhead 510, the bulkhead 710 comprises a bulkhead body 715. The bulkhead body 715 defines a somewhat elongated cylindrical device. In this respect, the bulkhead body 715 includes an outer diameter and an inner diameter. In one aspect, the bulkhead body 715 is fabricated through an additive manufacturing process. The bulkhead body 715 is fabricated from a polycarbonate or other non-conductive material.

The bulkhead body 715 has a first end 712, and a second end 714 opposite the first end 712. The first end 712 serves as an upstream end and is designed to receive wires (not shown) or a threaded terminal (not shown) that delivers an actuation signal for the single use setting tool 160. At the same time, the second end 714 serves as a downstream end and extends into the ignition chamber 620.

A bore 705 extends from the first end 712 to the second end 714 of the bulkhead body 715. The bore 705 represents the inner diameter of the bulkhead body 715, and is configured to hold an elongated brass pin 720. In the view of FIG. 7A, a downstream end 724 of the brass contact pin 720 is visible extending from the second end 714 of the bulkhead body 715. It is understood that the elongated contact pin 720 extends through the bore of the bulkhead body 715 along its length.

Figure 7B:
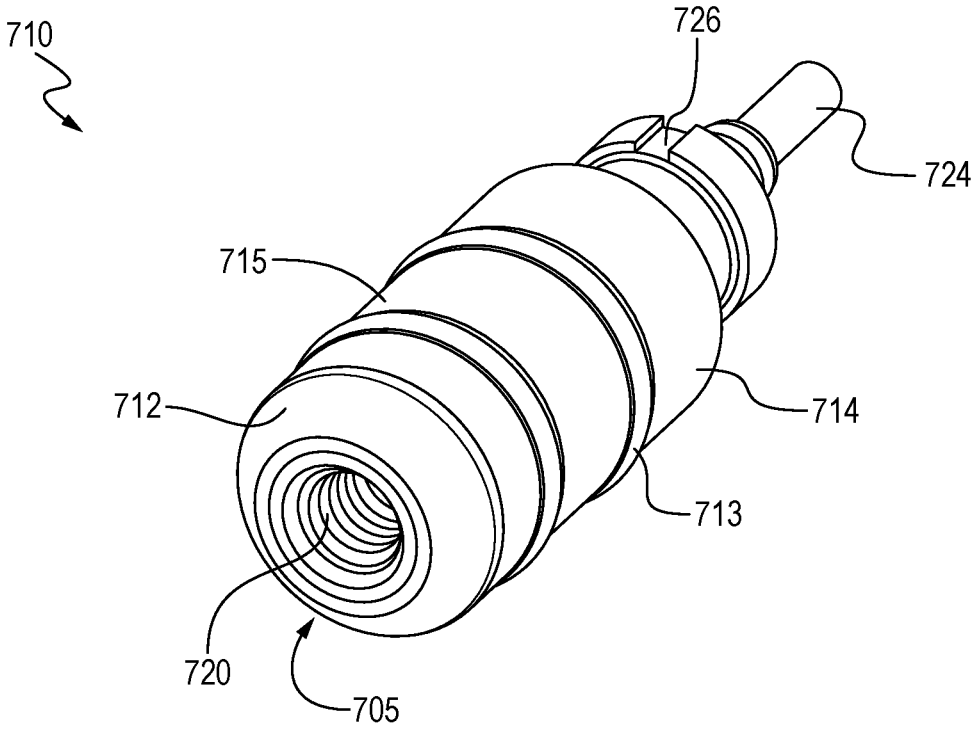
FIG. 7B is a first perspective view of the bulkhead of FIG. 7A. The bulkhead is seen from the upstream end. A threaded bore is shown within the bulkhead.
Figure 7C:
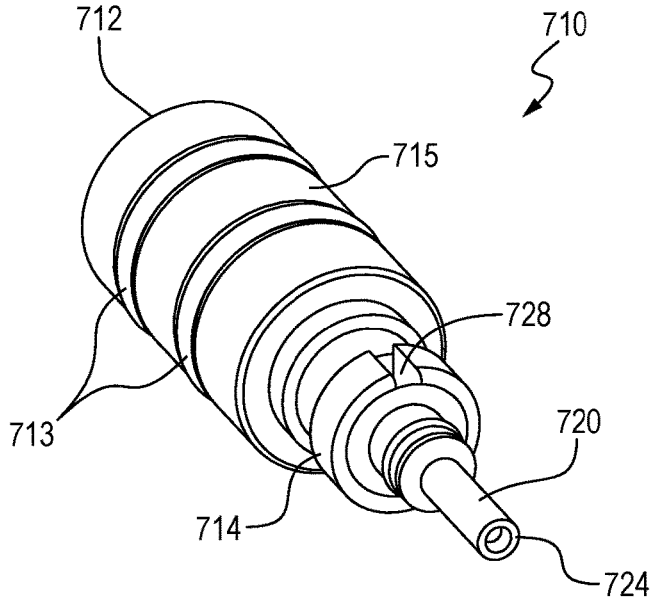
FIG. 7C is a second perspective view of the bulkhead of FIG. 7A. Here, the bulkhead is seen from a downstream end.

FIG. 7B is a first perspective view of the bulkhead 710 of FIG. 7A. FIG. 7C is a second perspective view of the bulkhead 710 of FIG. 7A. The brass contact pin 720 is seen extending from the second end 714 of the bulkhead body 715. In addition, O-rings 713 are shown around an outer diameter of the bulkhead body 715. The elastomeric O-rings 713 provide a fluid seal within the downstream chamber 304 of the firing head 300. The upstream end 712 of the bulkhead body 715 is left blank, meaning no brass pin portion extends therefrom.

The bore 720 at the upstream end 712 is threaded. This can be used to install a wire with a banana plug on it, or a threaded post or banana plug threaded in. In the case of a threaded post, the internal bore on the upstream end 712 of the tubular bore 720 may have a 10-24 female thread which receives a 4 mm banana plug as well as a 10-24 threaded post. Alternatively, a wire (not shown) may be crimped to a bullet terminal, and the bullet terminal then connected to the bore 720. The result is that the "gun shop" no longer has to connect the terminal and wire to the bulkhead 715 or add insulator boots, providing a more secure connection when compared to a soldered or welded wire connection.

Figure 8:
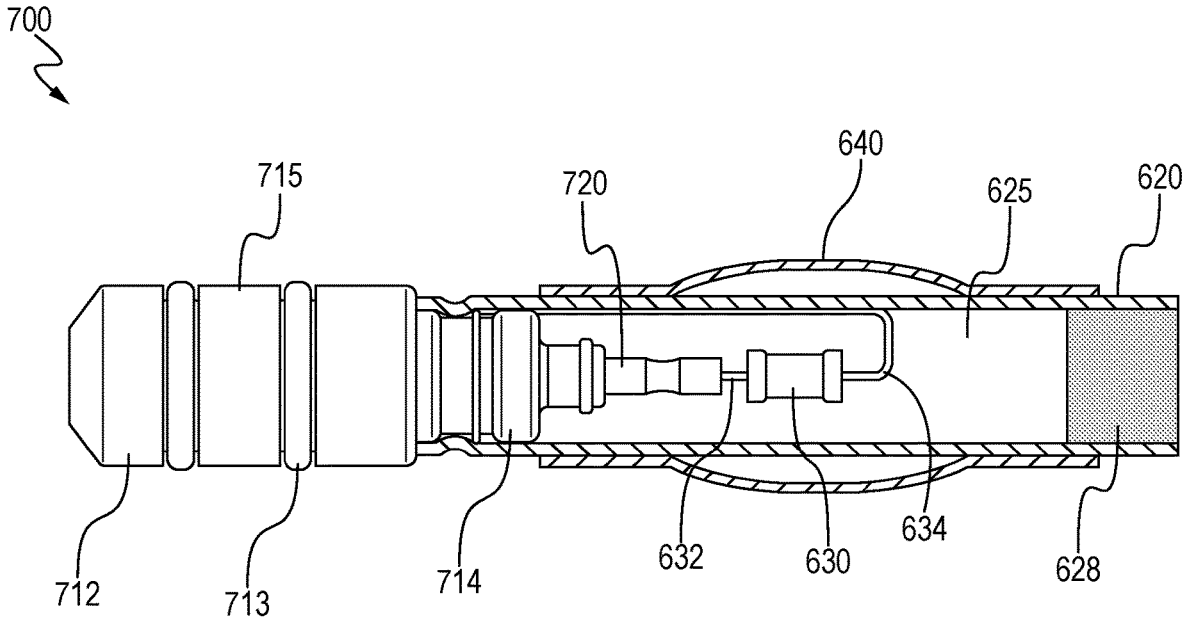
FIG. 8 is another side view of the bulkhead of FIG. 7A. Here, the bulkhead is in electrical communication with an igniter. The isolation tube is shown in cross-section.

FIG. 8 is another side view of the bulkhead 710 of FIG. 7A. Here, the bulkhead 710 is connected to the igniter 630 by means of the brass contact pin 720 and wire 632. The bulkhead 710, the igniter 630 and other components shown in FIG. 8 together comprise an initiator assembly 700. The initiator assembly 700 may be identical to the initiator assembly 600 except that the first end 712 of the bulkhead body 715 is "blank."

As can be seen, a novel initiator assembly is provided. In both initiator assembly 600 and initiator assembly 700, the respective bulkheads 510, 710 help protect the electronics (switch housing 350 and addressable switch 360) from damage that might otherwise occur as a result of burning and a build-up of resultant soot in the initiator chamber 620 when the explosive component 628 is set off.

All electrical connections for the initiator assembly may be made without the use of soldering or welding connections. Wire 632 of the igniter 630 is placed in a receiving bore of signal transmission pin 720. A crimp is then applied to the signal transmission pin locking the wire 632 in place. The ground wire 634 of the igniter 630 is wrapped around the non-conductive downstream end 714 of bulkhead body 715. The conductive metallic ignition chamber tube 620 is crimped over the downstream bulkhead end 714, making an electrical connection with ground wire 634 and retaining it in place. This allows a clean path from the ground wire 634, to the tube, to the cage, to the firing head 300, and return to the surface 105.

Figure 9A:
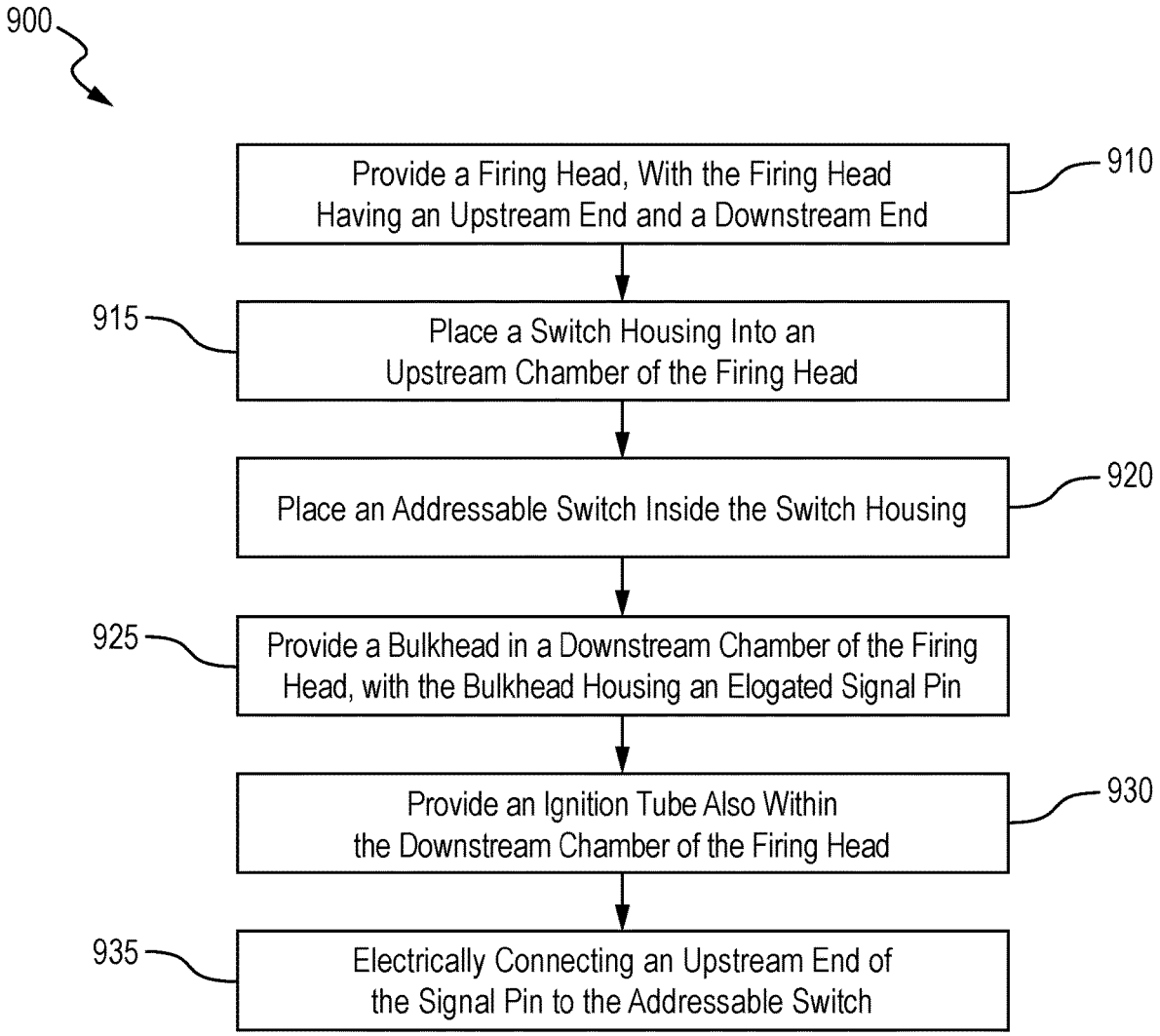
FIGS. 9A and 9B together present a flow chart showing steps for a method of setting a tool in a wellbore, in one embodiment.
Figure 9B:
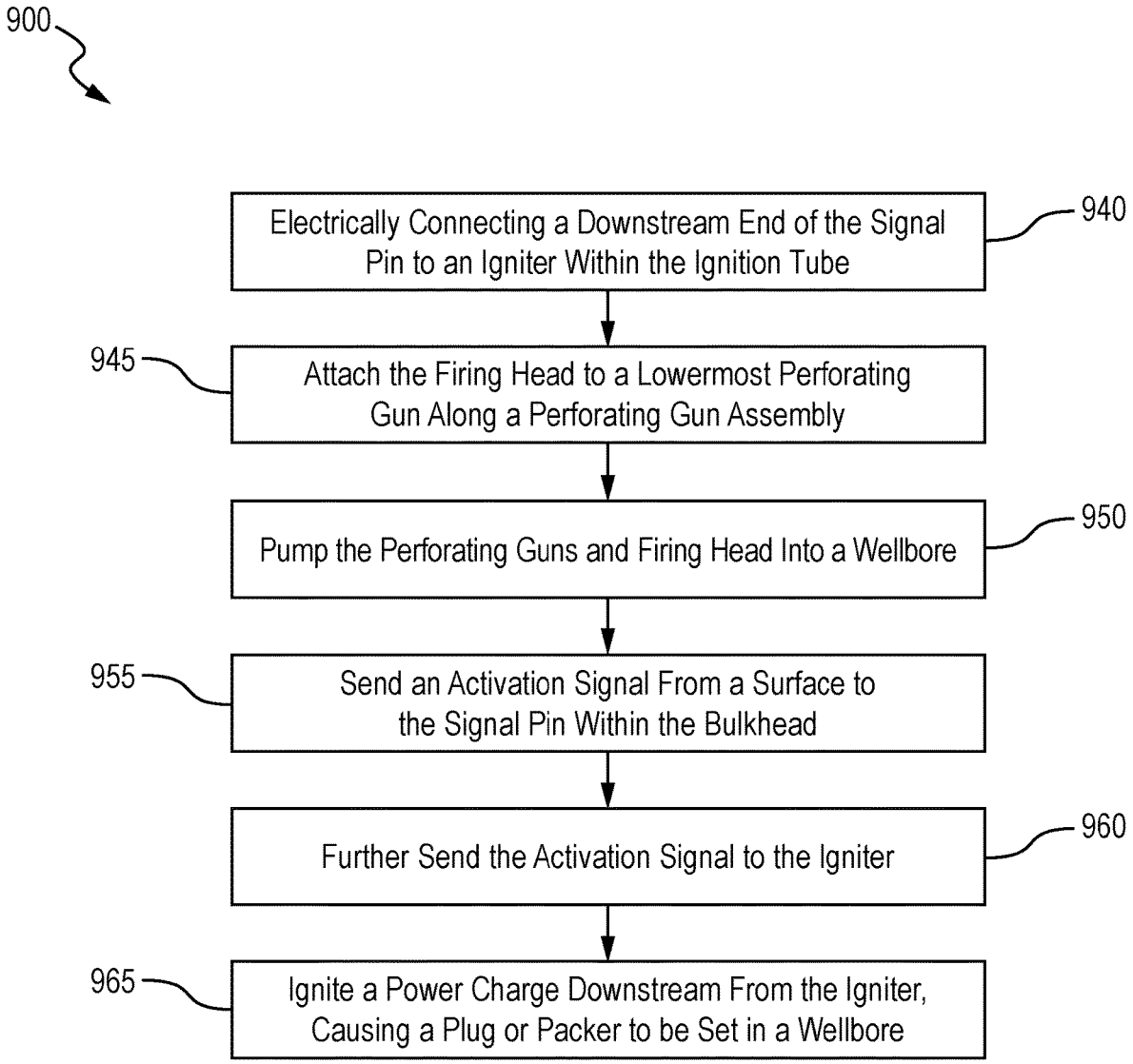

FIGS. 9A and 9B together present a flow chart showing steps for a method 900 of setting a tool in a wellbore. The tool is preferably a frac plug or a packer.

In one aspect, the method 900 first comprises providing a firing head. This is shown in Box 910. The firing head may be in accordance with the firing head 300 discussed above.

The method 900 next includes placing a switch housing into an upstream chamber of the firing head 300. This is provided in Box 915. Along with this, an addressable switch is placed inside of the switch housing. This is seen in Box 920. The switch housing may be in accordance with switch housing 350 shown above, while the addressable switch may be in accordance with addressable switch 360.

The method 900 further comprises providing a bulkhead in a downstream chamber of the firing head. This is indicated at Box 925. The bulkhead may be in accordance with either of bulkheads 510 or 710 described above. In this respect, the bulkhead houses an elongated signal transmission pin. The elongated signal transmission pin may be in accordance with the brass pin 520 described above.

The method 900 also comprises providing an ignition tube. This is shown in Box 930. The ignition tube also resides within the downstream chamber of the firing head. The ignition tube may be in accordance with the ignition tube 620 of FIG. 6A. Of interest, an upstream end of the ignition tube receives a downstream end of the signal transmission pin. Preferably, the upstream end of the ignition tube is crimped onto a downstream end of the bulkhead.

The method 900 further includes electrically connecting an upstream end of the signal transmission pin to the addressable switch. This is provided in Box 935 of FIG. 9B. Similarly, the method 900 includes electrically connecting the downstream end of the signal transmission pin to an igniter. This is shown in Box 940. The igniter also resides within the ignition tube.

In one aspect, the method 900 next includes attaching the firing head to a lowermost perforating gun along a perforating gun assembly. This is seen in Box 945. In this instance, the firing head acts as a tandem sub, threadedly connecting a gun barrel housing to a setting tool.

The method 900 then comprises pumping the perforating gun assembly and the firing head into a wellbore. This is provided in Box 950. Of course, the setting tool and the plug (or other settable device such as a packer) are pumped into the wellbore with the perforating gun assembly at the end of an e-line 240.

The method 900 then includes sending an actuation signal from the surface via the e-line 240 and down to the signal pin in the bulkhead. This is indicated at Box 955 of FIG. 9B. The actuation signal is further sent to the igniter. This is shown in Box 960.

The result of sending the actuation signal to the igniter is that an explosive component 628 is initiated which, in turn, initiates a power charge in the setting tool. This is seen at Box 965. This, in turn, causes a plug or a packer to be set in the wellbore. The perforating gun string, including the firing head, may then be pulled from the wellbore up to the surface or accompanying perforating guns may be fired.

It is observed that the igniter is initiated before the upstream guns are fired. Once a gun is fired the operator is no longer able to communicate with the plug switch and igniter.

The disclosed embodiments provide methods and systems for setting a plug within a wellbore. It should be understood that this description is not intended to limit the invention; on the contrary, the exemplary embodiments are intended to cover alternatives, modifications, and equivalents, which are included in the spirit and scope of the invention as defined by the appended claims. Further, in the detailed description of the exemplary embodiments, numerous specific details are set forth in order to provide a comprehensive understanding of the claimed subject matter. However, one skilled in the art would understand that various embodiments may be practiced without such specific details.

Further, variations of the initiator and detonation system and of methods for using the initiator system within a wellbore may fall within the spirit of the claims, below. It will be appreciated that the subject matter disclosed herein are susceptible to other modifications, variations, and changes without departing from the spirit thereof.

I claim:

1. An initiator system for a setting tool, comprising:
- a firing head comprising:
  - a tubular body having a first end, and a second end opposite the first end;
  - a bore extending from the first end to the second end, wherein the bore of the firing head has an upstream chamber and a downstream chamber;
- a tubular bulkhead residing in the bore of the firing head, with the tubular bulkhead having a first end, a second end, and a receptacle extending between the first end and the second end;
- a signal pin having an elongated shaft residing within the receptacle of the tubular bulkhead, and extending out from the second end of the tubular bulkhead, wherein the signal pin is fabricated from an electrically conductive material for transmitting an actuation signal;
- a cylindrical ignition tube having an upstream end and a downstream end forming an ignition chamber there between, wherein the upstream end of the ignition tube receives the second end of the tubular bulkhead within the downstream chamber of the bore of the firing head;
- an ignitor residing within the ignition chamber, with the ignitor being in electrical communication with the second end of the signal pin; and
- an explosive component also residing within the ignition chamber in proximity to the igniter.

2. The initiator system of claim 1, wherein:
- the firing head is fabricated from steel;
- the signal pin is fabricated from brass;
- the tubular bulkhead comprises a body fabricated from a non-conductive material; and
- the setting tool is configured to set a plug or a packer in a wellbore.

3. The initiator system of claim 2, wherein the non-conductive material comprises a poly-carbonate material or nylon or composite material.

4. The initiator system of claim 2, wherein the ignitor is in electrical communication with the second end of the signal pin by means of a wire such that the actuation signal may be transmitted through the wire to the ignitor.

5. The initiator system of claim 4, further comprising:
- an addressable switch; and
- a switch housing holding the addressable switch, with the switch housing residing within the upstream chamber of the bore of the firing head.

6. The initiator system of claim 5, wherein:
- the first end of the tubular body of the firing head is threadedly connected to a gun barrel housing of a perforating gun;
- the gun barrel housing comprises an electric line; and
- the electric line is configured to (i) transmit the actuation signal to the signal pin and on to the igniter.

7. The initiator system of claim 6, wherein the electric line is further configured to (ii) transmit a detonation signal to the addressable switch, which is then sent to a detonator to initiate perforating gun charges in the gun barrel housing.

8. The initiator system of claim 6, wherein an upstream end of the signal pin extends out from the first end of the bulkhead.

9. The initiator system of claim 8, wherein a banana clip is placed over the first end of the signal pin, and the electric line is in electrical communication with the banana clip.

10. The initiator system of claim 8, further comprising:
- a ground wire connected to the igniter;
- and wherein:
  - the wire connecting the second end of the signal pin to the igniter enters a receiving bore at the second end of the signal pin; and
  - the cylindrical ignition tube is crimped onto the second end of the tubular bulkhead, and the ground wire is wrapped around the second end of the tubular bulkhead beneath the cylindrical ignition tube to provide a solderless crimp connection.

11. The initiator system of claim 10, wherein:
- an upstream end of the signal pin resides entirely within the bore of the tubular bulkhead;
- the signal pin receives the actuation signal from a pre-wired bullet terminal inserted into the first end of the tubular bulkhead, resulting in a solderless connection; and
- the electric line is in electrical communication with the pre-wired bullet terminal.

12. The initiator system of claim 10, wherein:
- an upstream end of the signal pin resides entirely within the bore of the tubular bulkhead;
- the first end of the tubular bulkhead is threadedly connected to a conductive post;
- the signal pin receives the actuation signal from the conductive post; and
- the electric line is in electrical communication with the conductive post.

13. The initiator system of claim 5, wherein the explosive component is configured to initiate in response to resistive heat generated when the signal pin transmits the actuation signal to the igniter.

14. A method of actuating a setting tool in a wellbore, comprising:
- providing a firing head, comprising:
  - a tubular body having a first end, and a second end opposite the first end;
  - a bore extending from the first end to the second end, wherein the bore of the firing head has an upstream chamber and a downstream chamber;
  - a tubular bulkhead residing in the bore of the firing head, with the tubular bulkhead having a first end, a second end, and a receptacle extending between the first end and the second end;

a signal pin having an elongated shaft residing within the receptacle of the tubular bulkhead and extending from the second end of the tubular bulkhead, wherein the signal pin is fabricated from an electrically conductive material for transmitting an actuation signal;

a cylindrical ignition tube having an upstream end and a downstream end forming an ignition chamber there between, wherein the upstream end of the ignition tube receives the second end of the tubular bulkhead within the downstream chamber of the bore of the firing head;

an ignitor residing within the ignition chamber, with the ignitor being in electrical communication with the second end of the signal pin; and an explosive component also residing within the ignition chamber;

placing an addressable switch in the upstream chamber;

mechanically attaching the firing head to a lowermost perforating gun along a perforating gun assembly, wherein the perforating gun assembly receives an electric line;

electrically connecting an upstream end of the signal pin to the electric line;

electrically connecting a downstream end of the signal pin to the igniter;

mechanically attaching a setting tool for setting a fracturing plug to a lowermost end of the firing head; and sending an actuation signal from a surface of the wellbore, through the electric line, to the signal pin in the bulkhead, and to the ignitor, thereby initiating the explosive component which in turn ignites a power charge in the setting tool, causing the fracturing plug to be set in the wellbore.

15. The method of claim 14, further comprising:

after the fracturing plug is set, removing the perforating gun assembly and the firing head from the wellbore.

16. The method of claim 14, wherein the explosive component ignites in response to resistive heat generated when the signal pin transmits the actuation signal to the igniter.

17. The method of claim 16, wherein an upstream end of the signal pin extends out from the first end of the bulkhead.

18. The method of claim 17, wherein a banana clip is placed over the upstream end of the signal pin, and the electric line is in electrical communication with the banana clip.

19. The method of claim 16, wherein:

a ground wire is connected to the igniter; and the cylindrical ignition tube is crimped onto the second end of the tubular bulkhead, and the ground wire is wrapped around the second end of the tubular bulkhead beneath the cylindrical ignition tube to provide a solderless crimp connection.

20. The method of claim 16, wherein:

an upstream end of the signal pin resides entirely within the bore of the tubular bulkhead;

the signal pin receives the actuation signal from a pre-wired bullet terminal inserted into the first end of the tubular bulkhead, resulting in a solderless connection; and the electric line is in electrical communication with the pre-wired bullet terminal.

* * * * *